US008669451B2

(12) United States Patent
Turner

(10) Patent No.: US 8,669,451 B2
(45) Date of Patent: Mar. 11, 2014

(54) ERGONOMIC MARCHING BASS DRUM

(76) Inventor: Kenneth E. Turner, Appalachin, NY (US)

( * ) Notice: Subject to any disclaimer, the term of this patent is extended or adjusted under 35 U.S.C. 154(b) by 176 days.

(21) Appl. No.: 13/008,520

(22) Filed: Jan. 18, 2011

(65) Prior Publication Data

US 2011/0174136 A1 Jul. 21, 2011

Related U.S. Application Data

(60) Provisional application No. 61/296,195, filed on Jan. 19, 2010.

(51) Int. Cl.
*G10D 13/02* (2006.01)

(52) U.S. Cl.
USPC ..... 84/411 R

(58) Field of Classification Search
USPC ..... 84/411 R, 421
See application file for complete search history.

(56) References Cited

U.S. PATENT DOCUMENTS

| | | | | | |
|---|---|---|---|---|---|
| 2,858,724 | A * | 11/1958 | Troppe | ..... | 84/411 R |
| 4,102,236 | A * | 7/1978 | North | ..... | 84/411 R |
| 5,691,492 | A * | 11/1997 | May | ..... | 84/421 |
| 6,586,665 | B1 * | 7/2003 | Liao et al. | ..... | 84/411 R |
| 7,825,318 | B2 * | 11/2010 | Ito | ..... | 84/411 R |

* cited by examiner

*Primary Examiner* — Kimberly Lockett
(74) *Attorney, Agent, or Firm* — Brown & Michaels, PC

(57) ABSTRACT

An ergonomic marching bass drum having an angled shell constructed in such a way as to allow the batter (playing) head to be positioned parallel to the shoulders of the performer, rather than perpendicular to them, as is the case with the conventional marching bass drum. In addition, the angled shape and orientation of the shell puts the batter head in a position which is ergonomically comfortable for the performer to play on, since it make possible the use of the conventional matched grip percussion stroke used on virtually all percussion instruments.

16 Claims, 4 Drawing Sheets

ERGONOMIC MARCHING BASS DRUM

REFERENCE TO RELATED APPLICATIONS

This application claims one or more inventions which were disclosed in Provisional Application No. 61/296,195, filed Jan. 19, 2010, entitled "Ergonomic Marching Bass Drum". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of musical instruments. More particularly, the invention pertains to bass drums.

2. Description of Related Art

The conventional marching bass drum, shown in FIGS. 6 and 7, requires the use of a percussive stroke on a horizontal plane. Such drums are cylinders 37 of varying diameters constructed in such a way as to require the use of 2 batter (playing) heads 30 and 34. The batter heads 30 and 34 are held by hoops 31 and 35, which are attached to a cylindrical body 37 by lugs and claws 33. Rings 32 allow the drum to be held by a strap over the player's shoulders.

The batter heads 30 and 34 are located perpendicular to the performer's shoulders so that the performer must strike the right batter head 34 with the right hand, and the left batter head 30 with the left hand. Both batter heads 30 and 34 must be tuned to the same relative pitch in order to produce tonal consistence on each drum. This limits the potential tuning possibilities on the conventional instruments. A resonant head can not be used on the conventional marching bass drum of the art, since it requires two batter heads.

For purposes of projection and rhythmic clarity, one of the batter heads must face toward the audience. In order to do so, players are required to march facing sideways for virtually the entire time they are performing. This has become the standard marching and playing technique in the marching arts for bass drum sections.

The current state of the art of movement (marching) in the pageantry arts, (i.e. Marching Band, Drum and Bugle Corps, Color Guard, Indoor Marching Percussion, etc.), requires a specialized and somewhat archaic marching technique due to the design of the conventional marching bass drum. Presently, performers must continually cross their legs while moving sideways in order for the instrument to face forward and project toward the audience.

As far as can be determined, no current marching bass drum is similar in design to the ergonomic marching bass drum of the present invention. Some contemporary marching snare drums (the Dynasty Wedge Snare Drum) have a wedge shaped bottom to help with the projection of snare sound. In addition, some contemporary marching tenor drums or toms (Yamaha Toms/Tenor Drums) have a diagonal cut on the bottom of the instrument to assist with projection.

SUMMARY OF THE INVENTION

The ergonomic marching bass drum of the invention has an angled shell constructed in such a way as to allow the batter (playing) head to be positioned parallel to the shoulders of the performer, rather than perpendicular to them, as is the case with the conventional marching bass drum. In addition, the angled shape and orientation of the shell puts the batter head in a position which is ergonomically comfortable for the performer to play on, since it makes possible the use of the conventional matched grip percussion stroke used on virtually all percussion instruments. That is, with the back of the hands facing up and the thumbs facing in.

The resulting angle of the batter head may range from approximately 30 degrees to 60 degrees from horizontal, with a slight angle of adjustment possible via the harness (carrier) connection. The ergonomic angled shell changes the orientation of the drum to the performer by 90 degrees from that of the conventional marching bass drum.

DETAILED DESCRIPTION OF THE INVENTION

Figure 1:
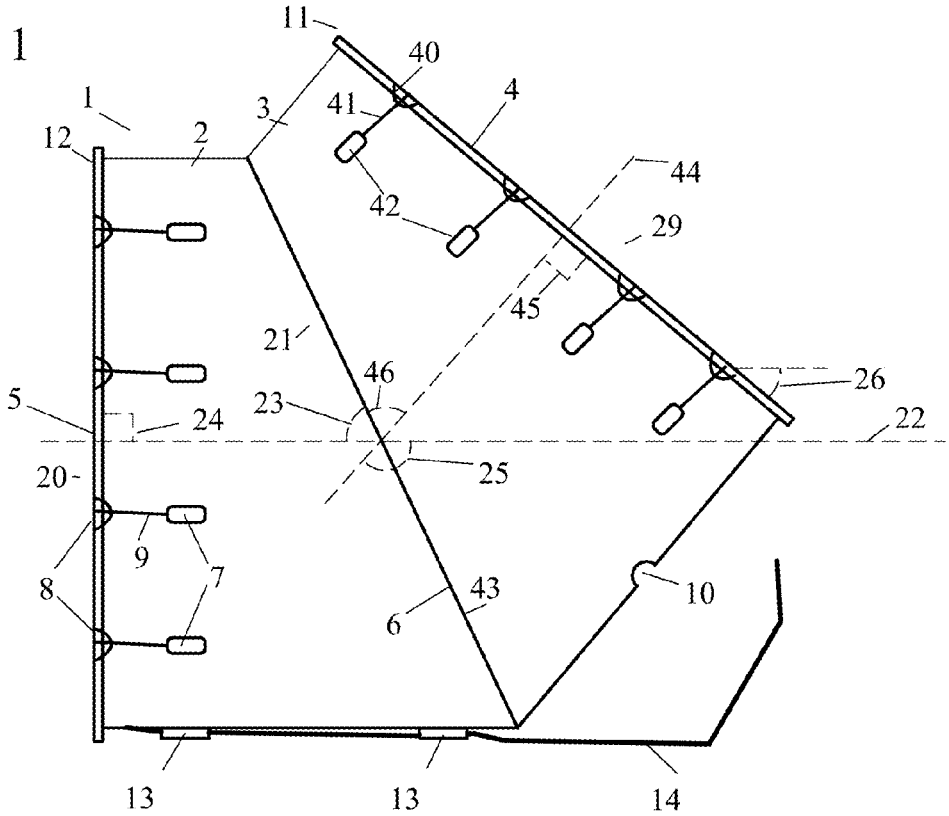
FIG. 1 shows a left side view of the ergonomic marching bass drum.
Figure 2:
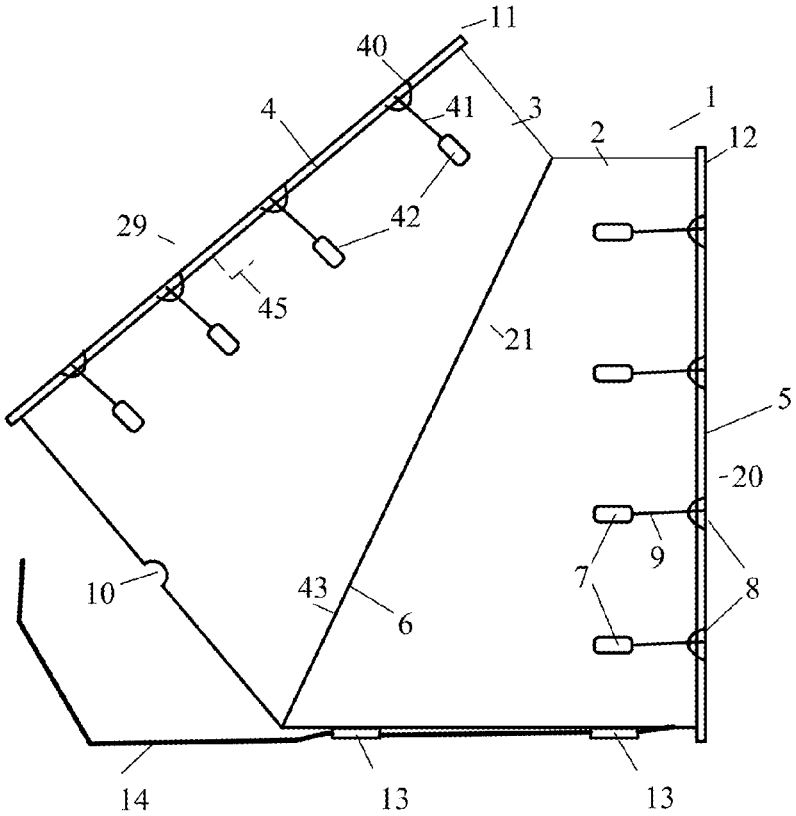
FIG. 2 shows a right side view of the ergonomic marching bass drum.
Figure 3:
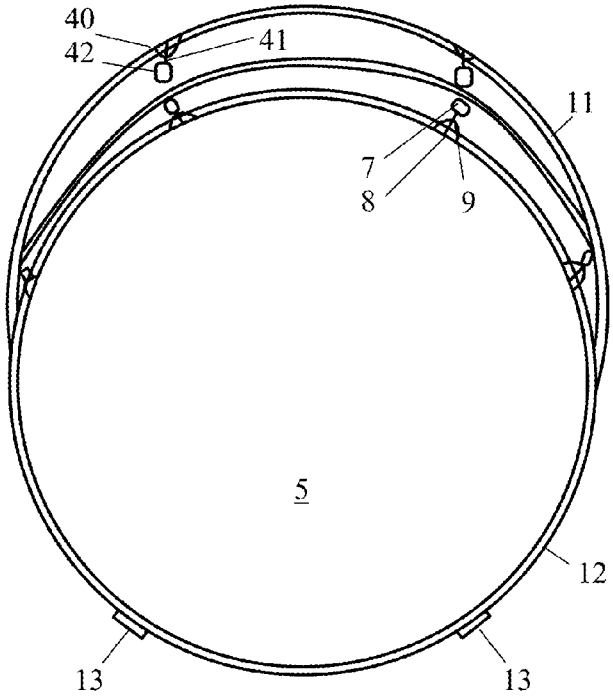
FIG. 3 shows a front view of the ergonomic marching bass drum.
Figure 4:
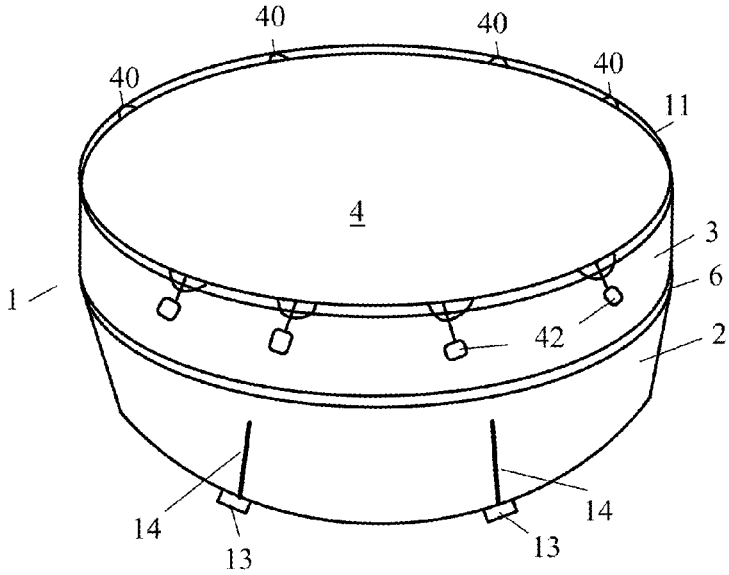
FIG. 4 shows a rear view of the ergonomic marching bass drum.

The ergonomic marching bass drum of the invention is a musical instrument used in the marching arts and is designed to solve several significant problems associated with the design of the conventional marching bass drum currently in use. As its name implies, its design makes the instrument both easier to play, using conventional percussive strokes and techniques, and easier to march with. In addition, since it requires the use of only one batter (playing) head, it makes possible a wider range of tuning options and playing techniques than are currently available. Since the orientation of the player to the ergonomic marching bass drum is rotated 90 degrees from that of the orientation of the player on the conventional marching bass drum, several significant problems associated with movement (marching) with the conventional marching bass drum are no longer an issue.

As shown in FIGS. 1 through 5, the ergonomic marching bass drum of the invention is built around an ergonomic angled shell 1—a cylinder shaped acoustic resonating chamber/shell. The shell 1 is made up of two pieces—resonance section 2 and playing section 3. Resonance section 2 has an open end 20 which is perpendicular 24 to the axis 22 of the resonance section 2, and an opposite end 21 is cut on an angle 23 to the axis 22. Similarly, playing section 3 has an open end 29 perpendicular 45 to an axis 44 of the cylindrical body of the section 3, and an opposite end 43 cut on an angle 46 to the axis 44.

The angles 23 and 44 are chosen such that the axis 22 of the cylindrical body of resonance section 2 and the axis 44 of the cylindrical body of playing section 3 meet at an angle 25 of between 120°-150°, with approximately 130° being preferred.

In FIG. 1, as an example, the axis 22 of resonance section 2 meets axis 44 of the playing section 3 at an angle 25 of 130°, with angles 23 and 46 being approximately 65°. In this example, if the drum is held such that the axis 22 of the resonance section 2 is horizontal and the open end 20 is vertical, the angle 26 of the batter head 4 to the axis 22 (and thus the playing angle relative to the ground) would then be approximately 40°.

The ergonomic angled shell 1 is preferably made from ten ply maple or birch plywood, which creates an excellent resonating chamber for the instrument. Other types of plywood, including plywood with a different number of plies, may be used as well. Although the plywood shell creates a resonating chamber which provides warmth and resonance to the sound, it is also possible to build the ergonomic angled shell of fiberglass, metal, plastic, hard rubber, carbon fiber or any of a number of other composite materials or compounds.

The shell 1 can be made by joining resonance section 2 and playing section 3 via the use of bonding adhesives, fasteners and/or a connecting band 6 to form the angled shell 1. The shell 1 may also be of one piece construction if it is made of plastic, fiber glass, carbon fiber or another type of compound or material capable of being molded. For cosmetic purposes, the shell 1 may be finished by painting, staining or applying a wood, metal or plastic veneer to the surface of the shell.

A variety of cylinder sizes can be made, preferably from about 16" to 30" in diameter including, but not limited to: 16", 18", 20", 22", 24", 26", 28" and 30" shells, although larger or smaller sizes are possible. Sizes are preferably compatible with the large number of commercially available drum heads currently in use. The drums can thus be provided in sets of instruments, usually five to a set, intended to produce a wide range of relative pitches—the smaller the drum, the higher the pitch, the larger the drum, the lower the pitch.

Batter head 4 is mounted at the open end 29 of playing section 3. The batter head or playing head is the drum head located closest to the performer and the head which is struck by the player to produce the sound of the drum. The batter head 4 can be any commercially available product as used on all membranophones (drums).

A cylindrical hoop 11 is used to attach the batter head 4 to the open end 29 of the playing section 3. The hoop 11 may be made from twelve ply maple or birch plywood, although it may also be made of other types of plywood, including plywood with a different number of plies, as well as fiberglass, metal, plastic, hard rubber, carbon fiber or any of a number of composite materials, as known to the art.

The hoop 11 is attached to the playing section 3 by a number of claws 40—typically there may be sixteen to twenty-four claws 40, as is conventional to the drum art. The claws 40 are preferably made from metal, although they may also be made of wood, fiberglass, metal, plastic hard rubber, carbon fiber or any of a number of composite materials. For strength or aesthetic purposes, they may be chrome plated, painted or powder coated. The specific shape, size or design of the claw 40 may be altered for strength or aesthetic purposes.

Tensioning rods 41 connect the claws 40 to lugs 42. The tensioning rods 41 are preferably square headed, threaded rods which can be tensioned using a standard drum key. The tensioning rods 41 and lugs 42 are preferably made from metal, although they may also be made of fiberglass, metal, plastic hard rubber, carbon fiber or any of a number of composite materials. For strength or aesthetic purposes, they may be chrome plated, painted or powder coated. The specific length of the rods 41 may need to be altered due to the size of the drum on which they will be used. The lugs 42 can be attached to the playing section 3 by screws or other conventional means known to the art.

Resonant head 5 is an optional non-playing head attached across the open end 20 of resonance section 2. The resonant head 5 helps provide resonance and depth of sound to the instrument. As with batter head 4, the resonant head 5 can be any commercially available product as used on all membranophones (drums).

Resonant head 5 is attached by hoop 12 to the open end 20 of resonance section 2. The hoop 12 may be made from twelve ply maple or birch plywood, although it may also be made of other types of wood as well as fiberglass, metal, plastic, hard rubber, carbon fiber or any of a number of composite materials, as known to the art.

The hoop 12 is attached to the resonance section 2 by a number of claws 8—typically there may be sixteen to twenty claws 8, as is conventional to the drum art. The claws 8 are preferably made from metal, although they may also be made of fiberglass, plastic, hard rubber, carbon fiber or any of a number of composite materials. For strength or aesthetic purposes, they may be chrome plated, painted or powder coated. The specific shape, size or design of the claw 8 may be altered for strength or aesthetic purposes.

Tensioning rods 9 connect the claws 8 to lugs 7. The tensioning rods 9 are preferably square headed, threaded rods which can be tensioned using a standard drum key. The tensioning rods 9 and lugs 7 are preferably made from metal, although they may also be made of fiberglass, plastic, hard rubber, carbon fiber or any of a number of composite materials. For strength or aesthetic purposes, they may be chrome plated, painted or powder coated. The specific length of the rods 9 may need to be altered due to the size of the drum on which they will be used. The lugs 7 can be attached to the resonance section 2 by screws or other conventional means known to the art.

If desired, a ported resonant head 5 (one with a hole in it) may be used on the ergonomic marching bass drum instead of a solid head. This lowers the pitch slightly and provides additional tuning options and tone quality adjustments. Again, if desired, the resonant head 5 may be eliminated completely, providing a more pointed and punctuated bass drum sound with more attack sound and intensity, and less resonance. This will also lower the relative pitch of the drum and make it possible to use a slightly smaller instrument to produce the same relative pitch as a larger drum, which can be useful for performers small in stature.

If the drum has a solid resonant head 5, it may be desirable to cut a small vent hole 10 to vent the internal pressure created when the batter head 4 is struck by the performer. This vent hole 10 is shown in the figures in the playing section 3, but it could be provided in the resonance section 2 within the teachings of the invention. The size of the vent hole 10 may vary based on the size of the drum—the smaller the drum, the smaller the hole, the larger the drum, the larger the hole. If desired, the vent hole 10 can be provided with a liner such as a rivet which lines and protects the vent hole, as is known to the drum art.

As shown in FIGS. 1-4, connector attachment blocks or rests 13 are preferably attached to the bottom of the drum with screws or other attachments known to the art. These blocks 13 receive carrier rods 14 used to connect the drum to a conventional carrier harness (not shown). The carrier rods 14 can be connected to the blocks 13 by screws or other conventional fasteners known to the art.

The blocks 13 also serve as supports which protect the shell of the instrument when it is stored or put down when not in use. The connector attachment blocks 13 are preferably made of metal, although they may also be made of fiberglass, plastic, hard rubber, carbon fiber or any of a number of composite materials. For strength or aesthetic purposes, they may be chrome plated, painted or powder coated.

Figure 5:
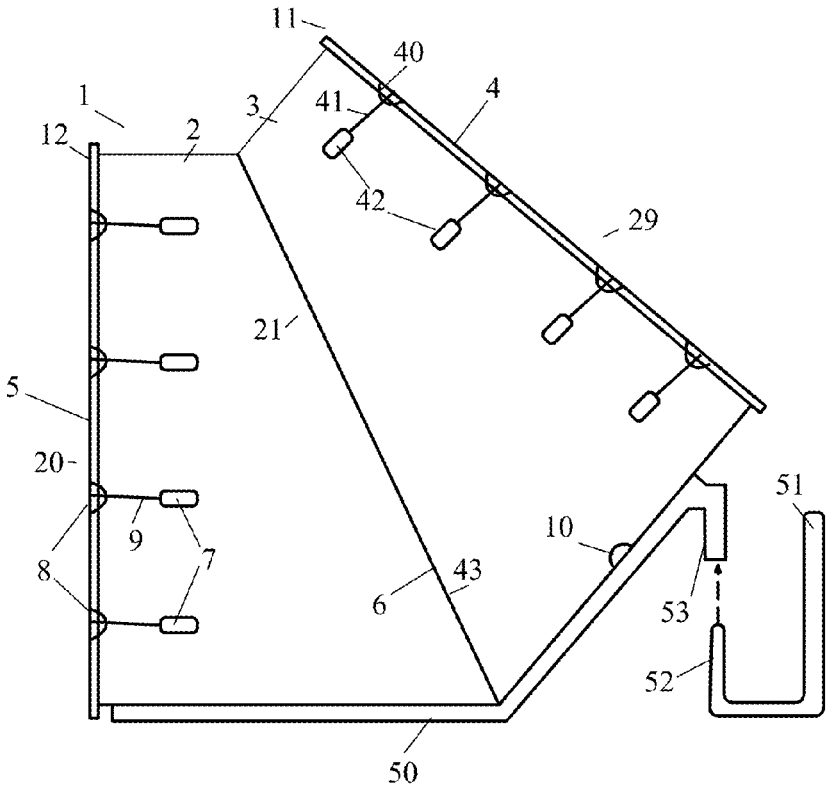
FIG. 5 shows a left side view of the ergonomic marching bass drum, corresponding with FIG. 1, but with an alternative carrier connection rail system used to attach the drum to a harness.

FIG. 5 shows an alternative to the carrier attachment blocks 13 and rods 14 of FIGS. 1-4. The alternative embodiment in FIG. 5 uses carrier connection rails 50, attached to the bottom and side of the drum. The carrier connection rails 50 are preferably made of metal, although they may also be made of fiberglass, plastic, hard rubber, carbon fiber or any of a number of composite materials. For strength or aesthetic purposes, they may be chrome plated, painted or powder coated. J-rod receivers 53 are provided on the end of the rails 50 adjacent to the batter head 4. These J-rod receivers 53 are designed to receive the upright ends 52 of standard J-rods 51, which are used on many of the currently available carriers.

Percussive Technique

The ergonomic marching bass drum is played using the standard matched grip percussion performance technique, in which sticks or mallets are held the same way with both hands, with the back of the hands facing up, and thumbs facing in. The player uses a primarily vertical stroke while playing on a single batter head. The batter head 4 is located directly in front of the player and at an angle which is preferably approximately parallel to the performer's shoulders.

Given the body orientation of the performer to the ergonomic marching base drum, and the fact that the performer can play on a single batter head 4, some of the traditional percussion performance, hand dampening and muting techniques which are not possible on the conventional marching bass drum, are now available for use and implementation on the ergonomic marching bass drum.

Because the performer plays on only one batter head 4 on the ergonomic marching bass drum, it is now possible to change the tone, pitch and resonating characteristics of the drum by playing on different areas of the batter head—that is by striking the center of the drum, the edge of the drum or the rim of the drum.

The performer's body orientation relative to the ergonomic marching bass drum makes possible the playing of percussion accessory instruments such as the wood block, cow bell, a-go-go bells, splash cymbals, etc, since they can now be mounted on the batter or resonant head rim via the use of any of a number of commercially available accessory mounting adapters. Although these accessories are not part of the invention, the ergonomic marching bass drum makes it possible to play them more easily by allowing the use of the standard percussion matched grip stroke to strike them.

Tuning

Figure 6:
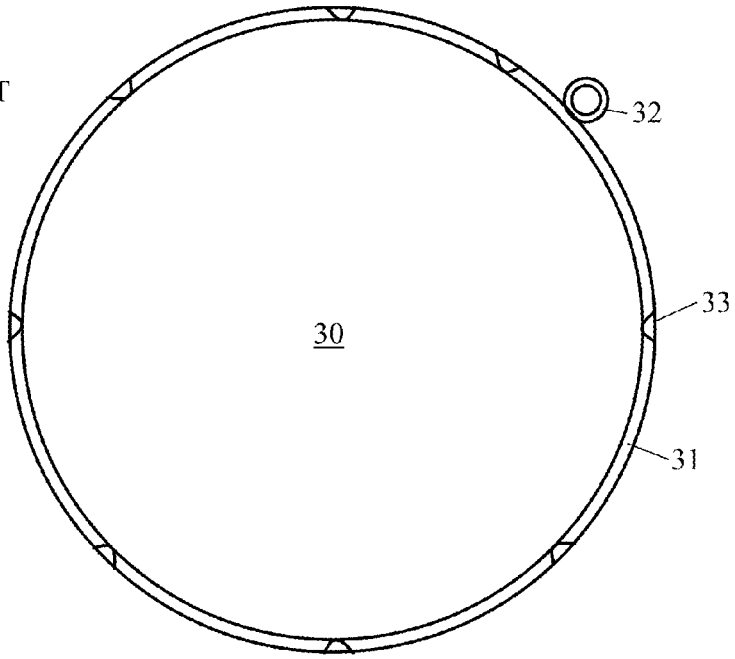
Fig. 6 PRIOR ART
FIG. 6 shows a side view of a prior art marching bass drum.
Figure 7:
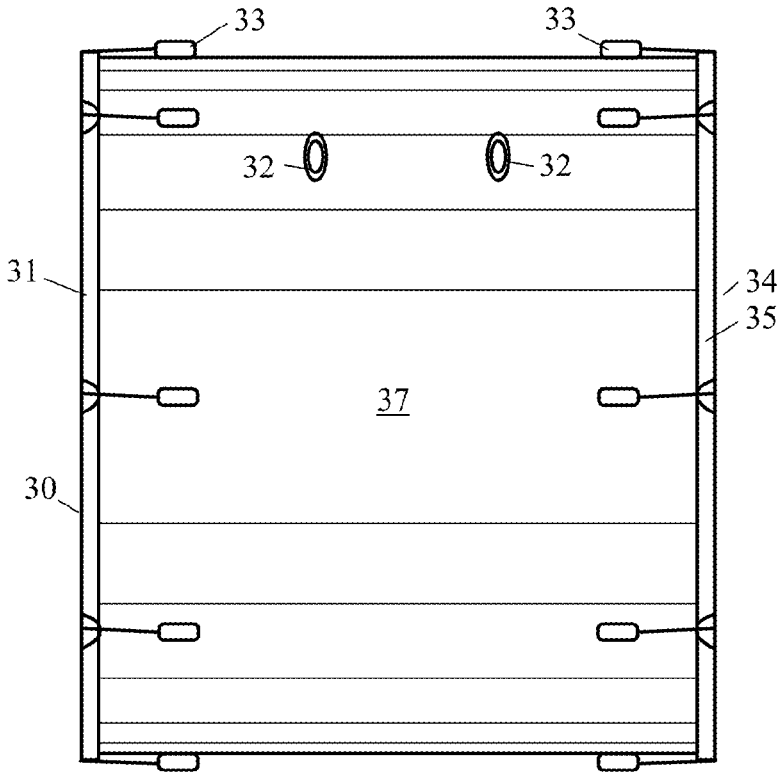
Fig. 7 PRIOR ART
FIG. 7 shows rear view of a prior art marching bass drum.

The ergonomic marching bass drum has a single batter head 4, and, optionally, a single resonant head 5, providing a wider range of tuning options than the conventional marching bass drum as shown in FIGS. 6 and 7, which has two batter heads 30 and 34 and no resonant head.

Since the performer plays on a single batter head 4, consistency of tuning is more easily achieved than on the conventional marching bass drum, because it is not necessary to make sure that the batter head 4 and resonant head 5 are tuned to exactly the same relative pitch. Instead, the batter head 4 and resonant head 5 can be tuned to a variety of relative pitches to produce a wider range of tuning combinations on each drum.

Because the batter head 4 and resonant head 5 do not need to be tuned identically, as is the case with the two batter heads on a conventional marching bass drum, a variety of commercially available muffling, muting, dampening and tone quality adjustment devices may be used on both the batter and resonant heads to produce variations in tone quality which are not possible on the conventional marching bass drum. The ergonomic marching bass drum makes possible a larger number of potential applications of these devices, since they may be applied independently or in various combinations on the batter and resonant heads to produce a variety of tone quality options.

Movement (Marching) Technique

The ergonomic marching bass drum makes marching and moving with the instrument attached to the player via the harness (carrier) easier than movement with the conventional marching bass drum.

Like all of the performers in the drum section, the bass drum section will now be able to move (march) while facing forward toward the audience, rather than being required to move with their bodies perpendicular (sideways) to the audience. Alternative marching techniques will no longer be required for the marching bass drum section.

Since the field of view when using the ergonomic marching bass drum is not blocked by the instrument, as is the case with some of the larger conventional marching bass drums, the possibility of a movement (marching) accident, which currently occurs when the bass drum section is required to back up or move forward in a direction parallel to the side lines, is virtually eliminated.

Marching bass drums with rear view mirrors mounted on them will no longer be required, since the blind back up move will not be necessary.

Instrument Stability

The ergonomic marching bass drum is easier for the performer to carry than the conventional marching bass drum. In the embodiment of FIGS. 1-4, the connector attachment blocks 13 are on the bottom and side of the instrument, so that the drum sits directly on the connecting rods 14, making gravity assist in the stability of the instrument. This is also the case if the drum is connected to the harness (carrier) via the use of the carrier connection rail or some other type of harness adaptor, for example the J-rod system shown in FIG. 5.

Since the ergonomic marching bass drum is positioned parallel to the performer's shoulders, instead of perpendicular to them, the center of gravity is closer to the performer than it is with the conventional marching bass drum, which makes the drum feel lighter and more stable to the performer.

When attached to any of the currently available harnesses, the ergonomic marching bass drum sits lower on the carrier than does a conventional marching bass drum. This helps provide a clear line of sight while moving with the instrument, which is a recurring problem with large conventional marching bass drums. The lower center of gravity also means that the instrument is being supported by the performer's entire body, rather than by the upper torso as is the case with the conventional marching bass drum. This provides additional comfort and stability to the ergonomic marching bass drum and makes it feel lighter.

Stagecraft

Like all of the performers in the drum section (also referred to as the battery), the bass drum section can now wear the costume jacket or uniform top over the harness, providing a more professional and consistent appearance to the entire battery.

From the point of view of the audience, the look of the traditional graduated bass drum section will remain the same, with the resonant (front) head facing the audience. The performers will now appear to be behind the instrument, in the same manner as the other members of the battery, rather than next to it, as is the case with the conventional marching bass drum section.

For creative musical and visual purposes, the bass drum can now be more easily used as a directional instrument.

Since the performer will not play on the resonant (front) head, a group insignia or logo may be placed on the head without fear that it will be defaced by being struck with mallets, sticks, brushes or other standard percussion implements.

When marching in parade formation, the ergonomic marching bass drum will project its sound forward rather than out to the side, making it easier for other members of the organization to hear the pulse from the bass drum section.

The ergonomic marching bass drum is specifically designed for use while moving (marching). Drum corps, marching bands and indoor marching percussion ensembles will be the principal users. However, it is likely that concert bands, orchestras, jazz ensembles and other concert musical performing groups may wish to use the instrument in a non-marching, stationary environment by detaching it from the carrier rods and mounting it on a standard concert bass drum, tom or percussion instrument stand. With a slight modification to the mounting brackets, it is also possible to use the instrument as a tom or bass drum voice on a standard drum set. Due to the more directional sound characteristics of the angled shell, it may be advantageous to adapt the design for use in making concert and marching toms, snare drums or other membranophones (any percussion instrument which utilizes a drum head to produce its sound).

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. An ergonomic drum comprising:

a) an angled shell comprising:

i) a playing section comprising a cylindrical body having an open end and an opposite end, the opposite end being formed on an angle to an axis of the cylindrical body; and ii) a resonance section comprising a cylindrical body having an open end and an opposite end joined to the opposite end of the playing section, the opposite end being formed on an angle to an axis of the cylindrical body;

b) a batter head mounted on the open end of the playing section; and c) a plurality of attachment blocks mounted to a bottom of the drum.

2. The drum of claim 1, wherein the angle between the axis of the cylindrical body of the playing section and the axis of the cylindrical body of the resonance section is between 120°-150°.

3. The drum of claim 2, wherein the angle between the axis of the cylindrical body of the playing section and the axis of the cylindrical body of the resonance section is 140°.

4. The drum of claim 1, further comprising a resonant head mounted on the open end of the resonance section.

5. The drum of claim 4, in which the resonant head is ported.

6. The drum of claim 4, in which the resonant head is held upon the open end of the resonance section by a cylindrical hoop held to the cylindrical body of the resonance section by a plurality of claws attached to the cylindrical body.

7. The drum of claim 6, in which the claws are attached to the cylindrical body by tensioning rods having adjustable length.

8. The drum of claim 1, in which the batter head is held upon the open end of the playing section by a cylindrical hoop held to the cylindrical body of the playing section by a plurality of claws attached to the cylindrical body.

9. The drum of claim 8, in which the claws are attached to the cylindrical body by tensioning rods having adjustable length.

10. The drum of claim 1, further comprising a plurality of carrier rods connected to the plurality of attachment blocks.

11. The drum of claim 1, in which the opposite end of the resonance section is joined to the opposite end of the playing section by a connecting band.

12. The drum of claim 1, in which the resonance section and the playing section are formed as a one piece shell.

13. The drum of claim 1 in which the angled shell is formed of plywood.

14. The drum of claim 1 in which the angled shell is formed of material chosen from the group consisting of plastic, fiber glass, carbon fiber, and a compound material capable of being molded.

15. The drum of claim 1 in which the cylindrical body of the resonance section and the cylindrical body of the playing section have diameters between 16 inches and 30 inches.

16. The drum of claim 1, further comprising a vent hole formed in a wall of the angled shell.

* * * * *